US008887937B2

(12) United States Patent
Ekkert

(10) Patent No.: US 8,887,937 B2
(45) **Date of Patent: *Nov. 18, 2014**

(54) HOT-FILL CROSS CAP WITH VENTS

(75) Inventor: Len Ekkert, Lemont, IL (US)

(73) Assignee: Phoenix Closures, Inc., Naperville, IL (US)

( * ) Notice: Subject to any disclaimer, the term of this patent is extended or adjusted under 35 U.S.C. 154(b) by 12 days.

This patent is subject to a terminal disclaimer.

(21) Appl. No.: 13/527,255

(22) Filed: Jun. 19, 2012

(65) Prior Publication Data

US 2013/0334225 A1 Dec. 19, 2013

Related U.S. Application Data

(63) Continuation-in-part of application No. 13/105,692, filed on May 11, 2011, which is a continuation-in-part of application No. 13/105,718, filed on May 11, 2011.

(51) Int. Cl.
*B65D 51/16* (2006.01)
*B65D 51/18* (2006.01)

(52) U.S. Cl.
USPC ..... 220/256.1; 220/254.1; 220/254.9; 220/366.1; 220/367.1

(58) Field of Classification Search
CPC .. B65D 2205/00; B65D 41/04; B65D 51/145; B65D 51/16; B65D 51/1622; B65D 51/165; B65D 51/1661; B65D 51/1688; B65D 51/18
USPC ..... 220/254.1–254.2, 254.7, 254.9, 255.1, 220/256.1, 366.1, 367.1, 368.1, 220/FOR. 203–FOR. 204; 215/276, 307, 215/309, 341, 343–345; 426/403
See application file for complete search history.

(56) References Cited

U.S. PATENT DOCUMENTS

| | | | | |
|---|---|---|---|---|
| 697,681 | A | 4/1902 | Smelker | |
| 2,041,403 | A | 9/1932 | Fergusson | |
| 2,040,798 | A | 6/1934 | Schoonmaker | |
| 2,135,834 | A | 11/1938 | Overmyer | |
| 2,383,747 | A * | 8/1945 | Sharp | 215/276 |
| 2,424,801 | A | 3/1946 | Crabbe et al. | |
| 2,427,819 | A * | 9/1947 | Thener | 215/276 |
| 3,042,247 | A * | 7/1962 | Bonnet | 220/366.1 |
| 3,059,800 | A * | 10/1962 | Mills | 215/261 |
| 3,110,599 | A * | 11/1963 | Kusinski et al. | 215/344 |
| 3,967,746 | A * | 7/1976 | Botkin | 215/260 |

(Continued)

OTHER PUBLICATIONS

U.S. Office Action dated Apr. 11, 2013 for corresponding U.S. Appl. No. 13/105,718 (publication US 2012-0285959 A1, published Nov. 15, 2012).

(Continued)

*Primary Examiner* — Mickey Yu
*Assistant Examiner* — Brijesh V. Patel
(74) *Attorney, Agent, or Firm* — Husch Blackwell LLP

(57) ABSTRACT

A two-part closure for use in conjunction with a liner. An upper part of the closure is substantially plate like and clips or snaps onto the lower part of the closure. The lower part of the closure includes recessed vents which allow air and/or moisture to escape from beneath the closure. The lowest part of the closure has sidewalls with interior threads or a snap-on rib, as desired. The upper portion of the lower part is open, with crossing ribs positioned a spaced distance above the sealing lip for the lower part.

13 Claims, 7 Drawing Sheets

(56) References Cited

U.S. PATENT DOCUMENTS

| | | | | | |
|---|---|---|---|---|---|
| 4,003,489 | A * | 1/1977 | Bingaman | 215/260 |
| 4,042,143 | A | 8/1977 | Biggins | |
| 4,121,729 | A * | 10/1978 | Husum | 215/276 |
| 4,122,964 | A | 10/1978 | Morris | |
| 4,174,784 | A | 11/1979 | Hartung | |
| 4,319,690 | A * | 3/1982 | Birrell et al. | 215/220 |
| 4,446,979 | A * | 5/1984 | Gach et al. | 215/203 |
| 4,540,099 | A * | 9/1985 | Swartzbaugh et al. | 215/252 |
| 4,765,499 | A * | 8/1988 | von Reis et al. | 215/261 |
| 4,984,700 | A | 1/1991 | Knickerbocker | |
| 5,062,538 | A * | 11/1991 | Ochs | 215/260 |
| 5,092,477 | A * | 3/1992 | Johnson et al. | 215/230 |
| 5,096,078 | A * | 3/1992 | McQueeny | 215/231 |
| 5,169,003 | A | 12/1992 | Traupman | |
| 5,251,809 | A | 10/1993 | Drummond et al. | |
| 5,280,842 | A * | 1/1994 | Koo | 215/220 |
| 5,297,696 | A | 3/1994 | Bernstein et al. | |
| 5,381,918 | A * | 1/1995 | Dahl | 220/784 |
| 5,839,592 | A | 11/1998 | Hayes | |
| 5,927,530 | A * | 7/1999 | Moore | 215/232 |
| 5,960,992 | A | 10/1999 | Bernstein et al. | |
| 6,202,871 | B1 * | 3/2001 | Kelly | 215/307 |
| 6,426,046 | B1 * | 7/2002 | Cassells et al. | 215/234 |
| 7,611,026 | B1 * | 11/2009 | Bloom et al. | 215/276 |
| 7,721,901 | B1 | 5/2010 | Von Spreckelsen et al. | |
| 7,780,024 | B1 | 8/2010 | Marsella et al. | |
| 7,798,319 | B1 * | 9/2010 | Bried et al. | 206/242 |
| 7,832,579 | B2 | 11/2010 | Lohrman et al. | |
| 7,938,282 | B1 * | 5/2011 | Hawry et al. | 215/305 |
| 8,474,634 | B1 * | 7/2013 | Branson et al. | 215/220 |
| 2002/0079286 | A1 | 6/2002 | Haynes et al. | |
| 2002/0088811 | A1 | 7/2002 | Lu | |
| 2004/0084452 | A1 * | 5/2004 | Hsieh | 220/256.1 |
| 2005/0236413 | A1 * | 10/2005 | Maciag et al. | 220/256.1 |
| 2005/0284837 | A1 * | 12/2005 | Taber et al. | 215/276 |
| 2006/0091099 | A1 | 5/2006 | Klepac et al. | |
| 2007/0034593 | A1 | 2/2007 | Ichimura et al. | |
| 2007/0187352 | A1 * | 8/2007 | Kras et al. | 215/276 |
| 2008/0302752 | A1 | 12/2008 | Farrar et al. | |
| 2009/0218351 | A1 * | 9/2009 | Antal, Sr. | 220/367.1 |
| 2010/0147848 | A1 * | 6/2010 | Rider et al. | 220/203.09 |
| 2010/0187245 | A1 | 7/2010 | Brown | |

OTHER PUBLICATIONS

U.S. Office Action dated Oct. 9, 2013 for corresponding U.S. Appl. No. 13/105,718 (publication US 2012-0285959 A1, published Nov. 15, 2012).

U.S. Office Action dated May 6, 2014 for corresponding U.S. Appl. No. 13/105,718 (publication US 2012-0285959 A1, published Nov. 15, 2012).

U.S. Office Action dated for Jul. 8, 2014 corresponding U.S. Appl. No. 13/105,718 (publication US 2012-0285959 A1, published Nov. 15, 2012).

U.S. Final Office Action dated Aug. 14, 2013 for corresponding U.S. Appl. No. 13/105,718 (publication US 2012-0285959 A1, published Nov. 15, 2012).

U.S. Final Office Action dated Jan. 31, 2014 for corresponding U.S. Appl. No. 13/105,718 (publication US 2012-0285959 A1, published Nov. 15, 2012).

U.S. Office Action dated May 19, 2014 for corresponding U.S. Appl. No. 13/105,692 (publication US 2012-0285965 A1, published Nov. 15, 2012).

U.S. Office Action dated Apr. 10, 2013 for corresponding U.S. Appl. No. 13/105,692 (publication US 2012-0285965 A1, published Nov. 15, 2012).

U.S. Office Action dated Oct. 9, 2013 for corresponding U.S. Appl. No. 13/105,692 (publication US 2012-0285965 A1, published Nov. 15, 2012).

U.S. Final Office Action dated Aug. 14, 2013 for corresponding U.S. Appl. No. 13/105,692 (publication US 2012-0285965 A1, published Nov. 15, 2012).

U.S. Final Office Action dated Feb. 12, 2014 for corresponding U.S. Appl. No. 13/105,692 (publication US 2012-0285965 A1, published Nov. 15, 2012).

U.S. Notice of Allowance dated Jul. 3, 2014 for corresponding U.S. Appl. No. 13/105,692 (publication US 2012-0285965 A1, published Nov. 15, 2012).

* cited by examiner

HOT-FILL CROSS CAP WITH VENTS

BACKGROUND OF THE INVENTION

1. Field of the Invention

The present invention relates generally to container closures, and more particularly to closures with liners for use in hot-fill containers.

2. Background of the Invention

When hot-filling a container, the container is capped when the contents are at an elevated temperature. The container is manipulated to ensure the hot contents eliminate any biological contaminants in the container. At the elevated temperature, the container bulges. When the contents cool, the volume of any gas in the container is reduced, which can cause the bulging container to flex inwardly slightly past its original blown dimensions. When the product requires that a liner be used, additional risks are encountered with hot-fill contents. When the contents cool, the liner may be pulled inwardly sufficiently to break the seal about the mouth sealing surface.

Further, the liner may retain water on top, for example, when the container is sprayed as a part of the cooling process. Retained water may then run out from the liner when the customer tears it off.

Also, the retained water may support the growth of bacteria on the liner as mold, which would present the consumer with an unsightly and an unsanitary situation on opening the food container for the first time.

SUMMARY OF THE INVENTION

In accordance with the present invention, there is provided a two part closure for use in conjunction with a liner. An upper part of the closure is substantially plate like and clips or snaps onto the lower part of the closure. The lower part of the closure has sidewalls with interior threads or a snap-on rib, as desired. The upper portion of the lower closure part is open, with at least one rib positioned a spaced distance above the liner, which is held in place by a circumferential downward facing sealing lip of the lower closure part. When in place on a container, the rib serves to limit the travel of the liner upward as it expands after the hot-fill of a product, thereby helping to maintain the seal of the liner on the container mouth, while allowing for moisture to be blown away after the subsequent cooling step where the container may be sprayed with water.

Alternatively, the lower part of the closure may include one or more vents which allow air and/or moisture to escape from underneath the closure even after the upper portion has been engaged with the lower portion on the container.

BRIEF DESCRIPTION OF THE DRAWINGS

The present invention will be more readily apparent from the following detailed description of the invention and the appended claims, when taken in conjunction with the accompanying drawings in which:

DETAILED DESCRIPTION OF THE PREFERRED EMBODIMENTS

Figure 1:
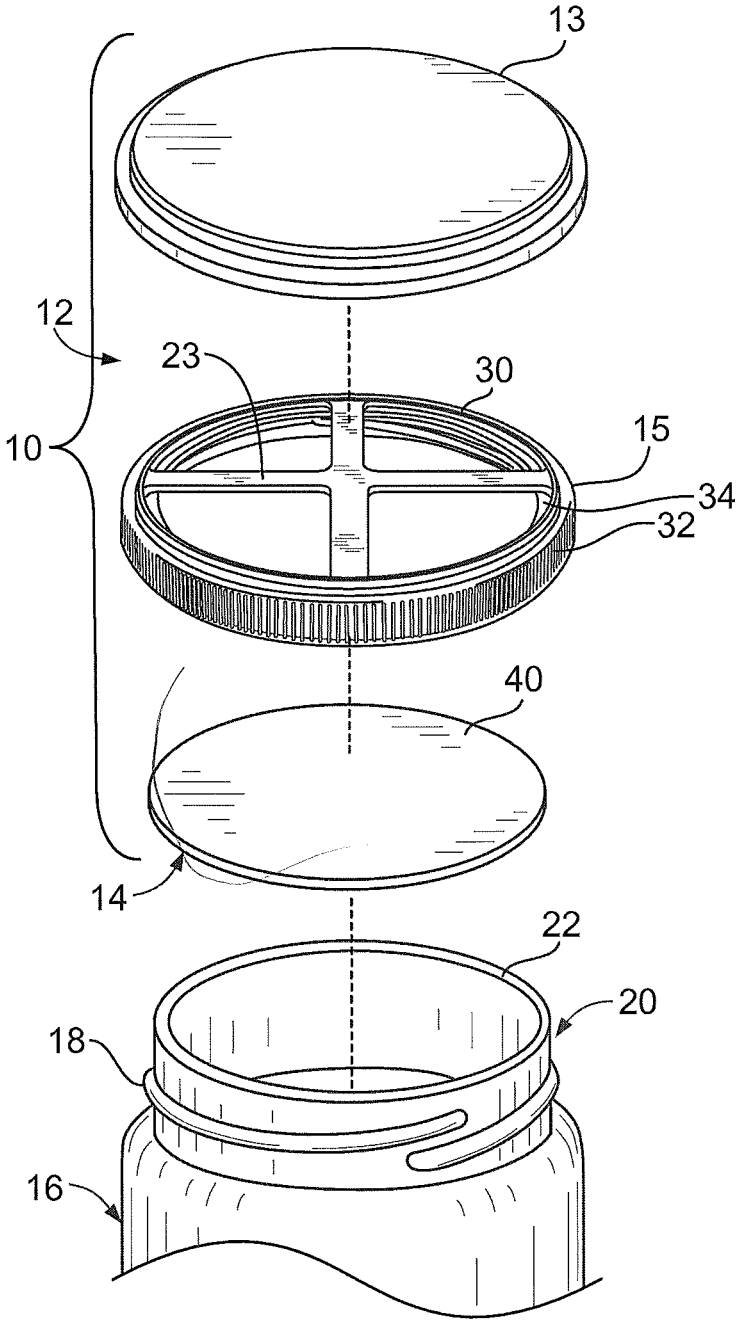
FIG. 1 is an exploded perspective view of a closure, liner and an associated container in accordance with the subject invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

Referring now to the figures and particularly to FIG. 1, there is shown a closure package 10 including a closure 12 and a liner 14 in a typical container cap and liner. The closure is formed of two portions, upper portion 13 and lower portion 15. The closure 10 is for use with an associated container 16. The exemplary container 16 has a threaded neck portion 18 with a finish 20. The finish 20 is that portion of the container 16 including the upper region which engages the cap 12, e.g., the threaded area 18 and an uppermost sealing surface 22 of the container 16. The container threads 18 engage complementary threads 36 (FIG. 2) formed on an inner surface of the lower portion of the closure 15. It will be recognized by those skilled in the art that the closure package 10 described herein can also be used with containers having a snap-like or beaded engagement configuration.

Figure 11:
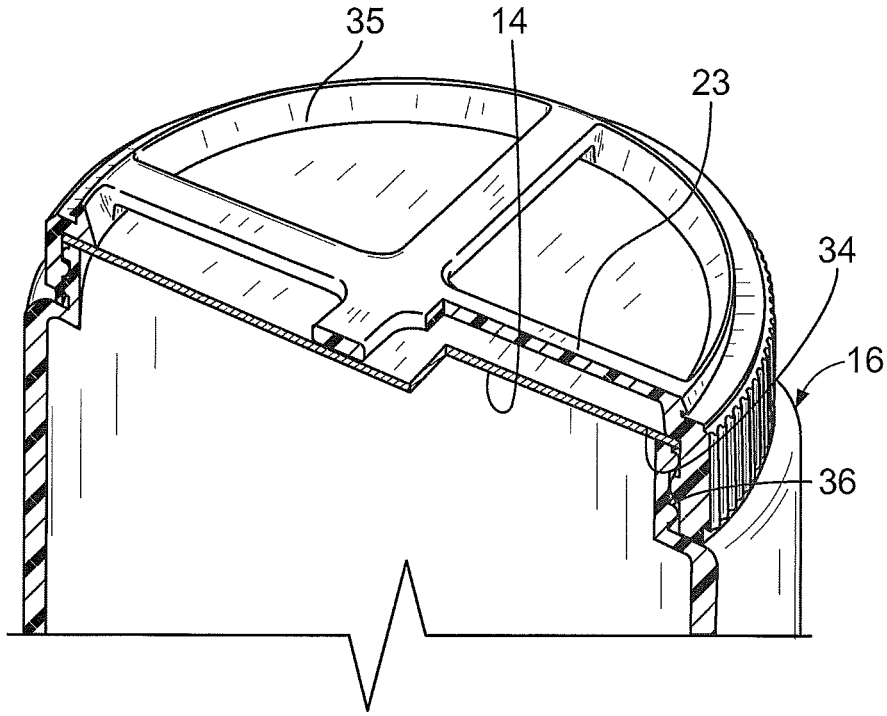
FIG. 11 is a cut-away view of the lower portion of the closure, a liner and the container.

The lower portion of the closure 15 has a top mostly open portion 30 with cross bars or ribs 23 positioned generally perpendicular to one another, although they may be at 70° to 110° to one another or parallel, as will be explained. A skirt portion 32 depends from the top portion 30. An upper portion 13 snap fits onto lower portion 15 and, when the two piece closure is on the container, seals the container. An inner shoulder 34 adjacent the skirt portion 32 is adapted to coact with the sealing surface 22 of the container 16 to form a seal therebetween, as will be seen. When the package is assembled, the liner 14 comprises a circular disc and resides between the sealing flange 34 of the cap 12 and the sealing surface 22 of the container 16, spanning the opening or mouth 36 of the container 16. The sealing surface 22 presents a flat surface for sealing to the liner 14, with a tapered surface 35 on the cap to the upper circumference of the lower portion (FIGS. 6 and 11) as an aid in removal of moisture from the cap. The tapered surface allows the beaded moisture remaining from the cooling spray to be more easily blown off the cap and bottle. Of course, surface 35 can also be vertical, if desired. Further, each rib tapers out at the juncture with the closure circumference as shown in FIG. 11, as an aid in release of the part from the mold.

Figure 6:
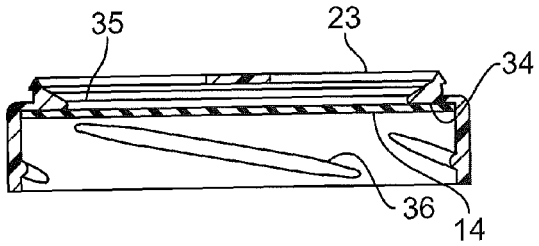
FIG. 6 is a partial cross-sectional view of the closure of the subject invention.

The liner 14 has a central portion 40 that is positioned over and in use, sealed at its circumference to the sealing surface 22 of the container 16. In normal (room temperature) use, the liner remains spaced from the ribs, as seen in FIGS. 6 and 11.

In one embodiment the liner 14 is formed from a laminate material having a resilient substrate layer, a foil or like gas-impermeable layer, and a heat activated bonding layer, such as a heat activated adhesive. In a current embodiment, the resilient substrate layer is a closed cell foam material, but can be chip board or paper backed and/or coated and is relatively impervious to the environs and establishes a substantially air-tight seal between the container 16 contents and the environs. The resilient material layer permits the cap 12 to be closely fitted to, and tightened onto, the container 16.

In a process of filling and capping a container in a hot-fill process, the container is first filled with the hot product, and then a liner is placed over the mouth of the container and heat-sealed. While the product is still hot or warm, the air in the space above the product expands, pushing the liner outward. If there is nothing in place to contain the bulging liner, the seal of the liner on the mouth can be broken. Therefore the container is capped as soon as possible after the placement of the liner on the container and the closure is screwed or pressed down to maintain the liner in place and complete the seal. The container is then cooled by spraying with cold water, and the closure is placed on the container. If water is not completely blown off the liner before the cap is in place, there may be microbial and/or fungal growth on the liner when the ultimate user of the product opens the container. The discovery of such a condition by a consumer would result in ill will towards the retailer and the manufacturer, as well as result in decreased sales. Applicant's two piece closure will not only retain the outward bulge of the liner and thereby assist in maintaining the seal, but will also allow a blast of air to blow away any moisture which may have accumulated during the cooling process, thereby averting any microbial or fungal growth.

Figure 3:
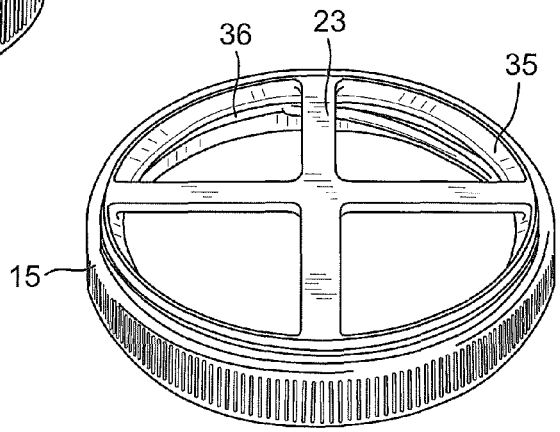
FIG. 3 is an upper perspective view of the bottom piece of the two piece closure of FIG. 1.
Figure 4:
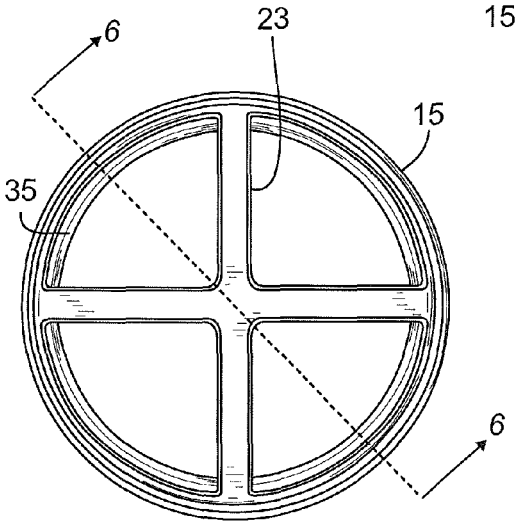
FIG. 4 is a top view of the bottom piece of the two piece closure of FIG. 1.
Figure 5:
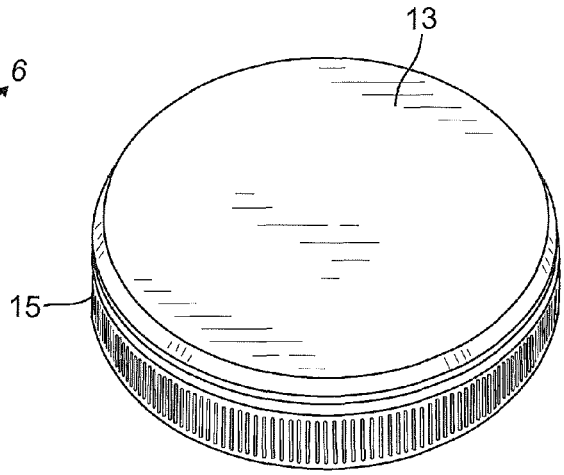
FIG. 5 is an upper perspective view of the two piece closure of FIG. 1 with both pieces shown together.

As shown in FIG. 3, the ribs are vertically spaced from the top of the liner when the liner is not under positive pressure from the product in the container. At least one rib, preferably two crossing ribs 23 extend across opening 30 of the lower piece 15 of the closure 12. The ribs are attached to the upper portion of the lower portion 15 of the closure.

Thus the ribs 23 are spaced 1 to 5 mm above the liner, thereby leaving sufficient open/upper space in the lower portion of the closure so that passage of the closure and container assembly past a blower will effectively eliminate moisture residing on the liner.

Figure 2:
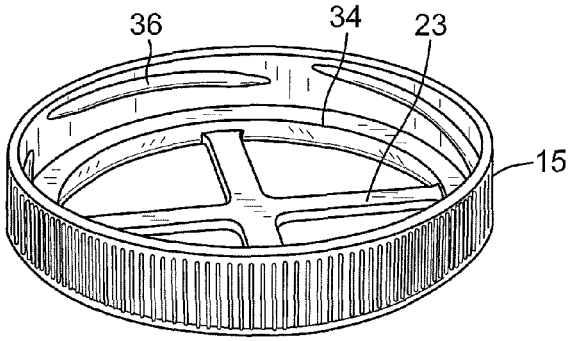
FIG. 2 is a bottom perspective view of the bottom piece of the two piece closure of FIG. 1.
Figure 7:
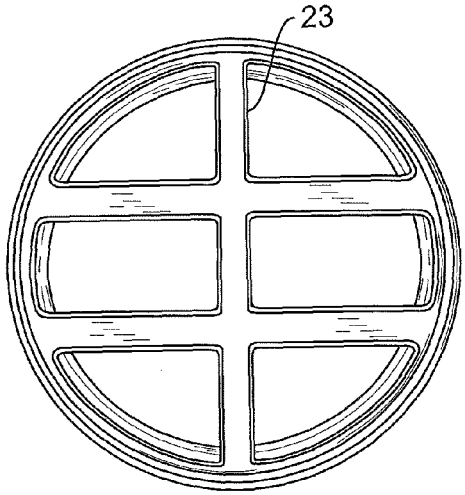
FIGS. 7, 8 and 9 are top views of alternate configurations of the bottom piece of the two piece closure of FIG. 1.
Figure 8:
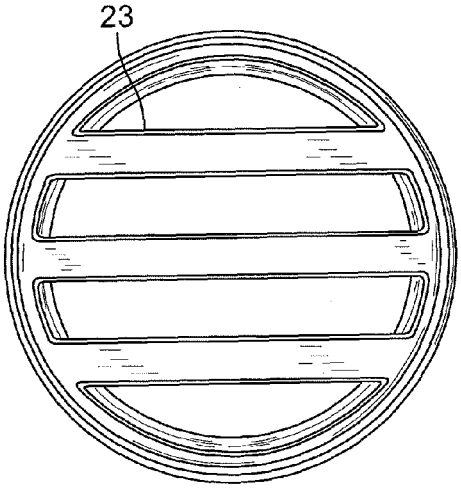
Figure 9:
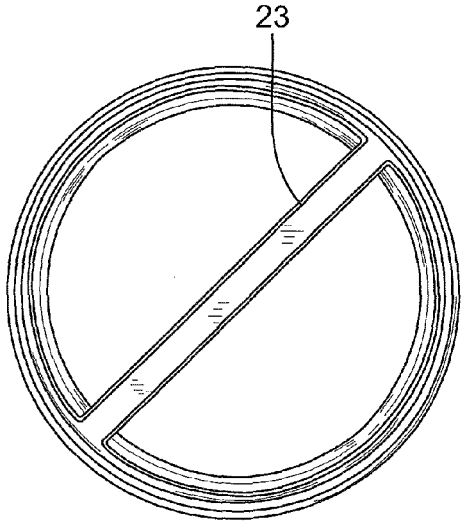
Figure 10:
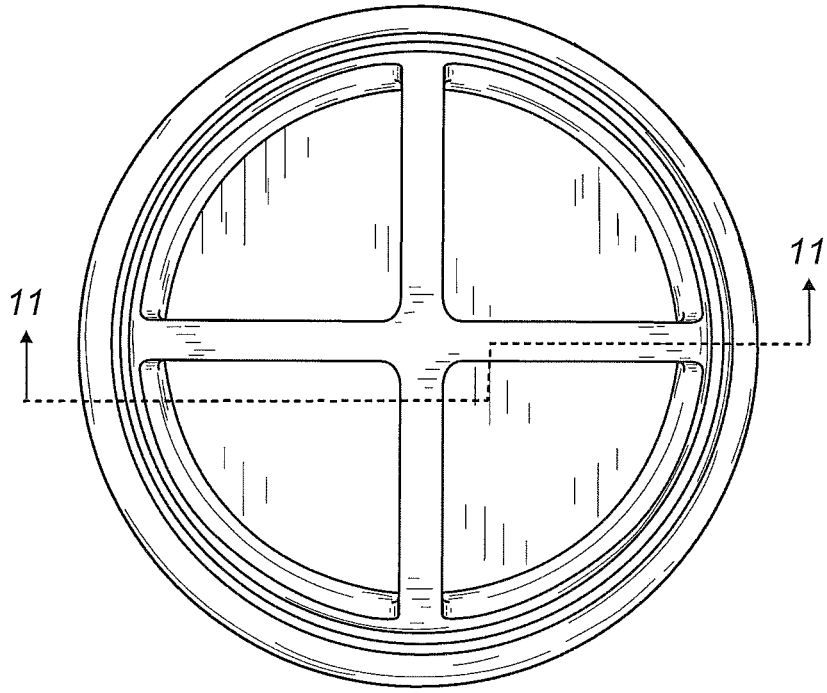
FIG. 10 is a top view of a portion of the closure, showing the liner beneath.

Instead of crossing ribs as shown in FIG. 2, other configurations, such as parallel (FIG. 8), grid (FIG. 7), or a single rib (FIG. 9) may be used.

Figure 12:
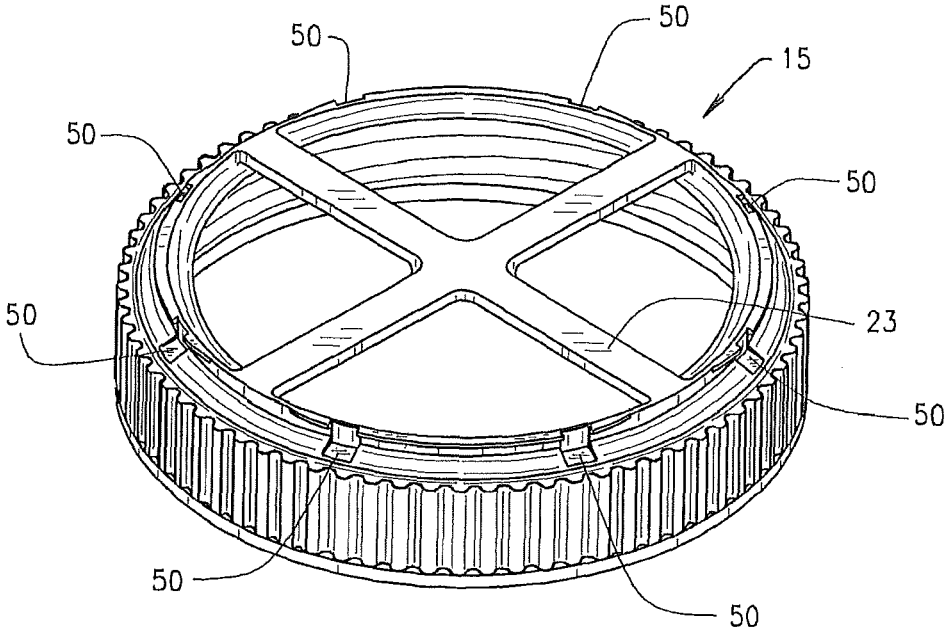
FIG. 12 is a perspective view of an alternative embodiment of the lower portion of the closure.
Figure 13:
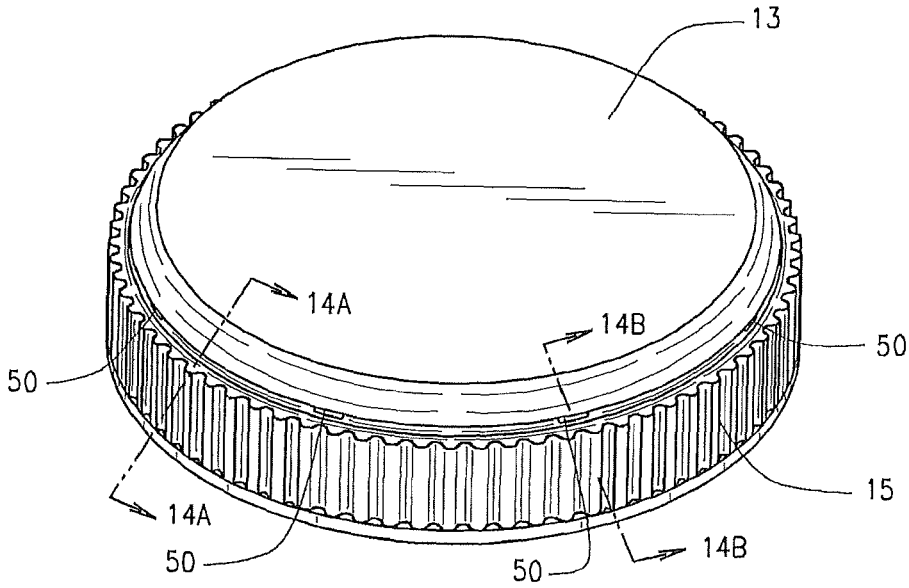
FIG. 13 is a perspective view of the upper portion of the closure as engaged with the alternative embodiment of the lower portion of the closure shown in FIG. 12.

An alternative embodiment of the two piece closure 12 designed to further reduce the amount of moisture left over from the cooling spray is shown in FIGS. 12-15. As can be seen in FIG. 12, the upper circumference of the lower portion 15 may include one or more recesses or "vents" 50 spaced around the upper circumference of the lower portion 15. When the upper portion 13 snap fits onto the lower portion 15 so as to "seal" the container, as shown in FIG. 13, the vents 50 allow atmosphere to be exposed to the top of the liner 14 seal during the drying process from the water bath that cools the hot product.

Figure 14:
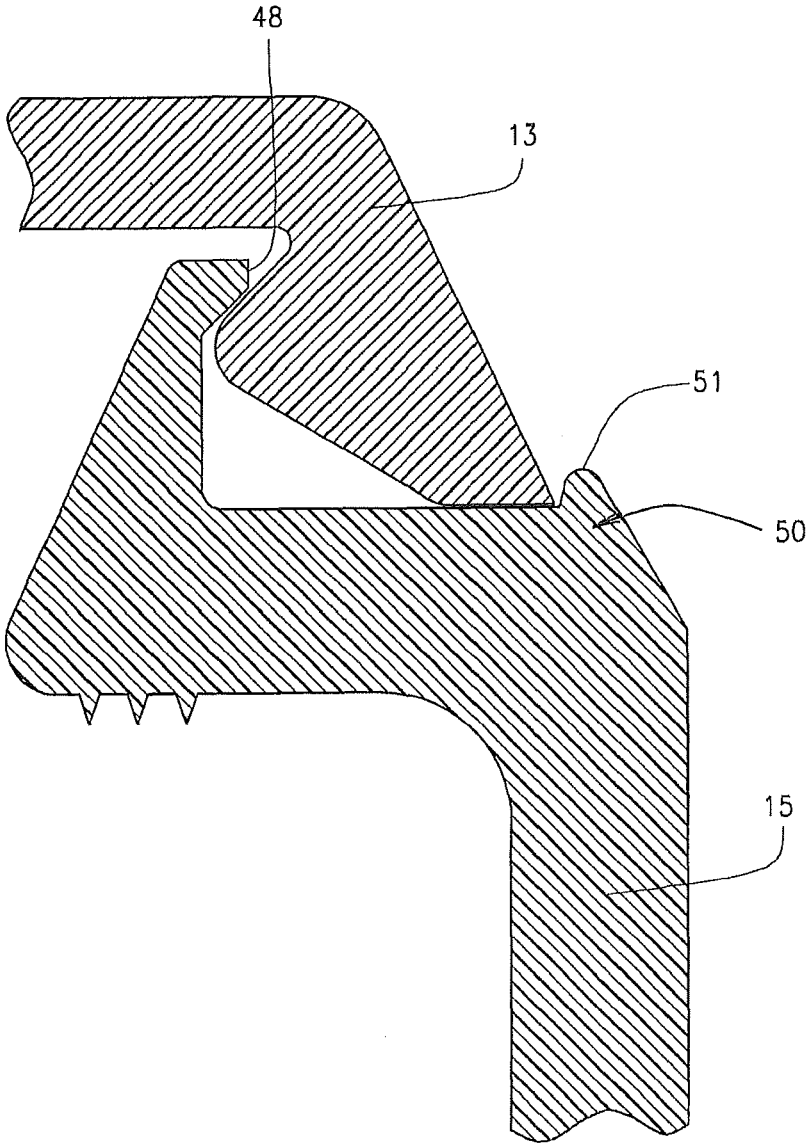
FIG. 14 is a partial cross-sectional view taken across line 14A-14A from FIG. 13, illustrating the upper portion of the closure as engaged with an alternative embodiment of the lower portion of the closure shown in FIGS. 12-13.

FIG. 14 illustrates a cross sectional view taken along line 14-14 from FIG. 13 where there is no vent. In one embodiment, in order to secure the upper portion 13 to the lower portion 15, the upper portion 13 engages with an outcropping 48 on the lower portion 15. Additionally, in order to prevent tampering, a bead may be present around the circumference of the lower portion 15. Although bead 51 is optional, when present it assists in preventing objects from being inserted under the edge of the upper portion 13 in an attempt to pry upper portion 13 from lower portion 15. Instead of the bead, the edge of upper portion 13 may fit into a depression in lower portion 15, thereby serving the same purpose as the bead.

Figure 15:
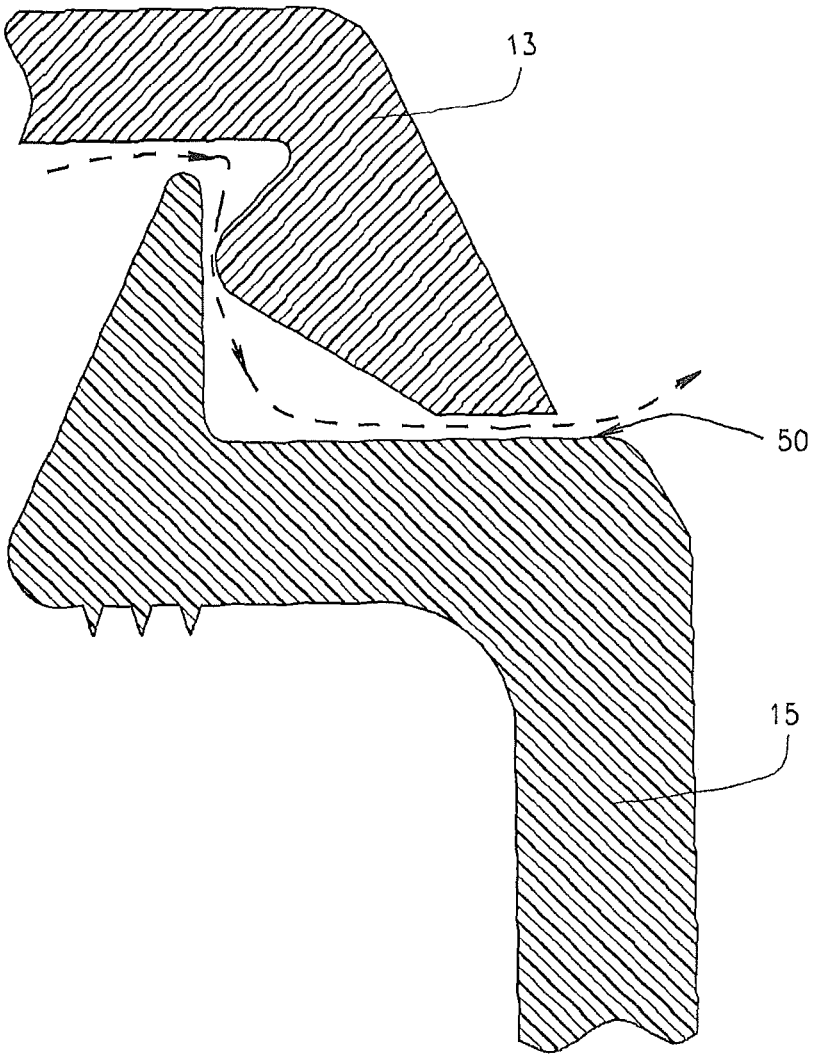
FIG. 15 is a partial cross-sectional view taken across line 14B-14B from FIG. 13, illustrating the upper portion of the closure as engaged with an alternative embodiment of the lower portion of the closure shown in FIGS. 12-13.

FIG. 15 illustrates a cross sectional view taken along line 15-15 from FIG. 13, at a vent. A vent 50 is formed by creating a recess in the upper circumference of the lower portion 15. At each vent 50, a gap is formed in the outcropping 48 so as to create a channel between inside of the closure and the ambient atmosphere. Thus, outcropping 48 does not appear in FIG. 15. Where bead is present on the lower portion 15, a gap may also be formed in the bead at vent 50. The channel may also end at the bead, with no external vent, if desired. A vent 50 allows air or moisture to escape out from underneath the closure 12 so as to reduce moisture and microbial and/or fungal growth on the liner 14 when the ultimate user of the product opens the container.

It will be understood that the foregoing description is of preferred exemplary embodiments of the invention and that the invention is not limited to the specific forms shown or described herein. Various modifications may be made in the design, arrangement, and type of elements disclosed herein, as well as the steps of making and using the invention without departing from the scope of the invention as expressed in the appended claims.

The invention claimed is:

1. A two piece closure for use with a container and comprising a resilient liner:

a lower portion having a sealing shoulder for pushing the resilient liner against a mouth of the container to effect a seal over the mouth, said lower portion having an opening on an upper end, and a crossbar spanning the opening;

an upper solid portion for covering said opening;

said resilient liner being in a plane over said mouth;

said cross bar being spaced from said plane over said resilient liner, so that upon expansion of said resilient liner upward, the crossbar limits travel of the expanding resilient liner while maintaining access to the resilient liner, and maintaining the seal;

said lower portion having a upper circumferential wall;

an upper retaining outcropping along the upper circumferential wall;

said upper retaining outcropping having at least one break along the upper circumferential wall;

said upper solid portion having a peripheral downward extending wall that engages said lower portion along said upper retaining outcropping of said upper circumferential wall, leaving a gap above the plane of said resilient liner and extending outside said peripheral downward extending wall, said upper solid portion enclosing a space above the resilient liner; and said gap providing a channel from said space to outside the two piece closure.

2. The two piece closure of claim 1 wherein the resilient liner is a foil composite liner.

3. The two piece closure of claim 1 wherein there are two crossbars disposed perpendicular to each other.

4. The two piece closure of claim 1 wherein there are a plurality of crossbars disposed parallel to each other.

5. The two piece closure of claim 1 wherein the crossbar is spaced from 1 to 5 mm above the plane of the resilient liner.

6. The two piece closure of claim 1 wherein the upper solid portion snaps onto the lower portion.

7. The two piece closure of claim 1, wherein the at least one break includes at least eight breaks.

8. A closure for use in conjunction with a container, said closure comprising:

a resilient liner, an upper solid section and a lower section, the resilient liner sealingly covering a mouth of the container, said lower section having at least two crossbars spanning a space over and spaced from said resilient liner;

said lower section having a upper circumferential wall;

an upper outcropping along the upper circumferential wall;

said upper outcropping having at least one break along the upper circumferential wall;

said upper solid section having a peripheral downward extending wall that engages said lower section along said upper outcropping of said upper circumferential wall, leaving a gap above said resilient liner and extending outside said peripheral downward extending wall, said upper solid portion enclosing the space above the resilient liner; and said gap providing a channel from the space to outside the closure.

9. The closure of claim 8 wherein said lower section has a shoulder on a circumferential wall, said shoulder pressing against said resilient liner for sealing said container.

10. The closure of claim 8 wherein said crossbars are disposed perpendicular to one another.

11. The closure of claim 8 wherein said crossbars are disposed parallel to one another.

12. The closure of claim 8 wherein the resilient liner is a foil composite liner.

13. The closure of claim 8 wherein the two crossbars are spaced 1 mm to 5 mm above the resilient liner.

* * * * *